United States Patent [19]

Lewinter et al.

[11] 4,070,820

[45] Jan. 31, 1978

[54] DOUBLE KITCHEN TIMER

[76] Inventors: Orest Lewinter; Barbara Lewinter, both of 104 Homestead Ave., Albany, N.Y. 12203

[21] Appl. No.: 715,896

[22] Filed: Aug. 19, 1976

[51] Int. Cl.[2] ..... G04F 3/02

[52] U.S. Cl. ..... 58/21.13; 58/21.11

[58] Field of Search ..... 58/1, 2, 7–11, 58/16.5, 21.11, 21.13, 22.9, 38, 85.5, 152 B, 56

[56] References Cited

U.S. PATENT DOCUMENTS

| | | | |
|---|---|---|---|
| 2,590,027 | 3/1952 | Mellard | 58/21.11 |
| 3,817,019 | 6/1974 | Fowler | 58/16.5 |

FOREIGN PATENT DOCUMENTS

| | | | |
|---|---|---|---|
| 751,913 | 7/1956 | United Kingdom | 58/21.13 |

*Primary Examiner*—Edith S. Jackmon

[57] ABSTRACT

This invention is a spring driven timer with primary and secondary time selection knobs rotating on a common center. The knobs are connected to a solid and a hollow concentric shaft, respectively, which in turn are connected to respective hammer mechanisms. When the primary knob is turned, a tab simultaneously turns the secondary knob to a desired longer time interval. Then the primary knob is set at a desired shorter time interval. When each knob (turned by a common clock mechanism) reaches the 0 time position, each respective hammer is impacted upon a single common bell. Two possible external embodiments of the device are presented.

2 Claims, 3 Drawing Figures

DOUBLE KITCHEN TIMER

BACKGROUND OF THE INVENTION

This double spring-driven timer would enable the user to easily time two events with a relatively inexpensive device. Several double timers have been developed in the prior art. However, they are all either driven electrically or are not constructed on a common center. A spring-driven double timer is more desirable than an electric timer due to its (a) greater portability and (b) non-consumption of energy. A double timer constructed on a common center is more desirable than two separate timers due to its (a) reduced cost, due to a common case, clock mechanism, and bell and (b) reduced bulk, allowing greater portability and placement on smaller surfaces.

SUMMARY OF THE INVENTION

Therefore, the principal object of this invention is to provide a spring-driven timer which can be pre-set to one or two different time periods, as desired.

Another object is to reduce the cost of manufacture and the bulk by construction on a common center.

An incidental advantage of this device is that, when it is used as an ordinary single timer, two hammers strike a common bell simultaneously, resulting in a louder signal than would result with one hammer.

A summary of the operation of the device is given in the Abstract.

The inventor does not wish to limit this invention to one embodiment, since there are many satisfactory embodiments possible. There may be variations in the design of the case as well as the time intervals desired. For instance, it may be desirable to construct a double timer with two different time scales, with one knob capable of being rotated to a maximum of one hour and the other knob to a maximum of 3 or 5 hours.

This invention, therefore, pertains to the general principal of a spring-driven double timer constructed on a common center, and includes any variation from the stated embodiments.

DESCRIPTION OF THE PREFERRED EMBODIMENTS

Figure 1:
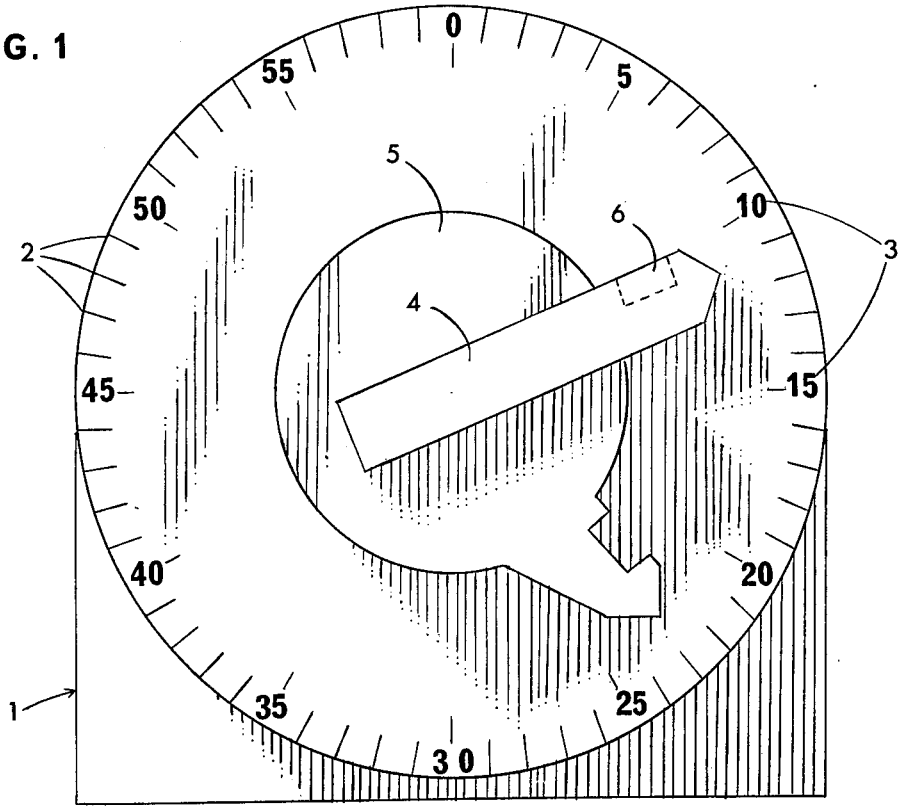
FIG. 1 is a front view of one embodiment of a Double Kitchen Timer

FIG. 1 shows a front view of one embodiment of this invention. The case 1 is provided with indicia or marks 2 equally spaced around the periphery and which represent minutes of time to which the timer may be set. Numerals 3 spaced at 5 minute intervals are also provided on the case 1 to give meaning to the indicia 2.

Before the timer is activated, the secondary knob 5 rests under the primary knob 4 and both knobs point toward the 0 minute numeral. If it is desired to time one event, the primary knob 4 is turned to the desired time interval up to a maximum rotation of 360°. The secondary knob 5 is simultaneously turned to this time interval by a tab 6 which is on the counterclockwize side of the primary knob 4. If it is desired to time two events, the secondary knob 5 is left at the longer desired time interval while the primary knob 4 is turned to the shorter desired time interval.

Figure 2:
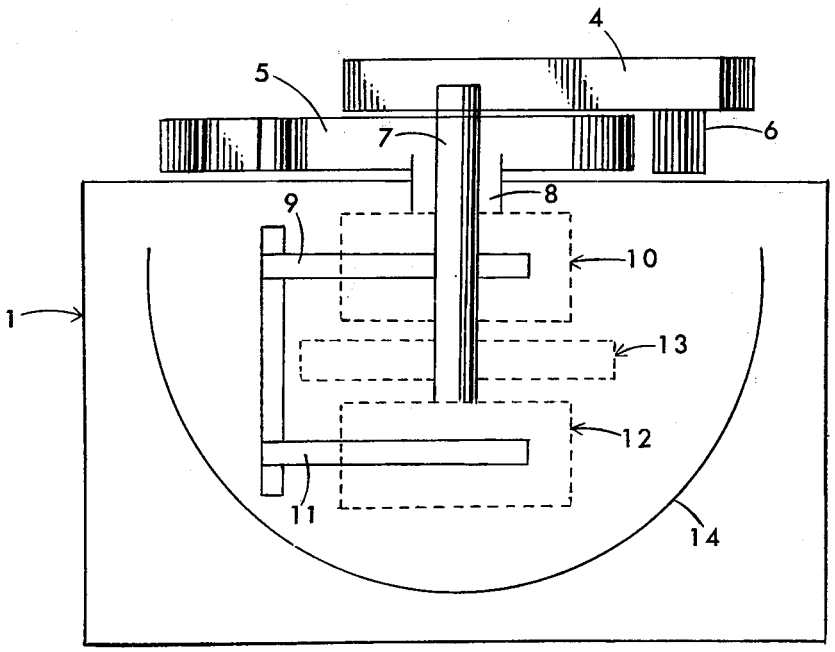
FIG. 2 is a horizontal (looking from the base) partially schematic cross-sectional view of the FIG. 1 embodiment taken through the center, with the primary knob 4 set at 90° clockwise and the secondary knob 5 set at 270° clockwize.

FIG. 2 shows a horizontal (looking from the base) partially schematic, cross-sectional view of the FIG. 1 embodiment taken through the center, with the primary knob 4 set at 90° clockwize and the secondary knob 5 set at 270° clockwize. The primary knob 4 is attached to a solid shaft 7 which extends to the rear hammer mechanism (schematic-12). The secondary knob 5 is attached to a concentric shaft 8 which is concentric around the solid shaft 7 and which extends to the front hammer mechanism (schematic-10).

When the primary knob 4 and secondary knob 5 (by means of the tab 6 are simultaneously turned clockwize from the 0 minute position, a common spring-driven clock mechanism (schematic-13) is activated which rotates both knobs counter-clockwize upon release of the knobs. Simultaneously, the front hammer mechanism (schematic-10) and the rear hammer mechanism (schematic-12) cause the front hammer 9 and the rear hammer 11, respectively, to be cocked and readied for striking the common bell 14.

After the desired time set by the primary knob 4 has expired and the primary knob 4 points to the 0 minute numeral, the rear hammer mechanism (schematic-12) releases the rear hammer 11, which, in turn, strikes the common bell 14.

At this point, the common clock mechanism (schematic-13) remains operational. After the desired time interval set by the secondary knob 5 has expired and the secondary knob 5 points to the 0 minute numeral, the front hammer mechanism (schematic-10) releases the front hammer 9, which, in turn, strikes the common bell 14. At this point, the common clock mechanism (schematic-13) ceases to function.

If both the primary knob 4 and secondary knob 5 are set to the same time interval, both the front hammer 9 and rear hammer (11) will strike the common bell 14 simultaneously, resulting in a louder signal than would occur if either one strikes the bell alone.

Figure 3:
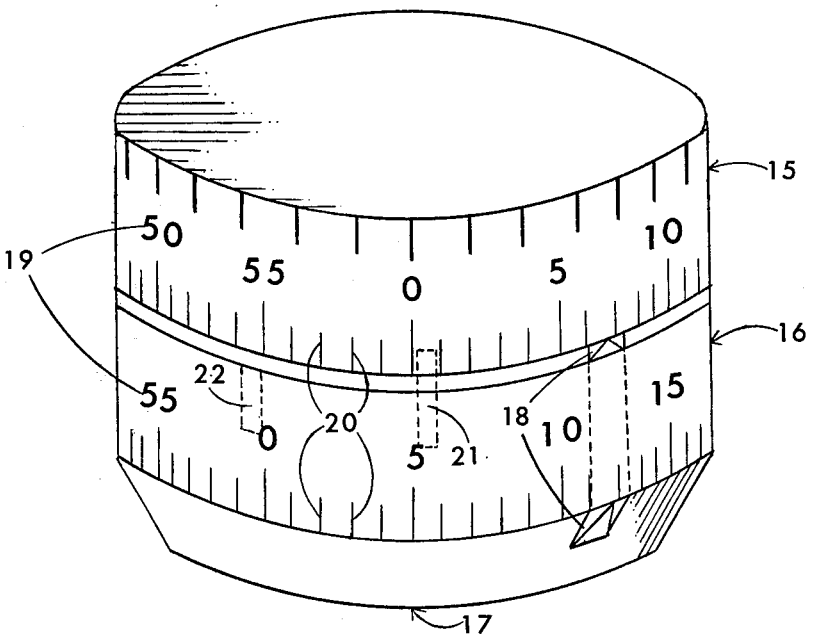
FIG. 3 is a perspective view of an alternate external embodiment of a Double Kitchen Timer.

FIG. 3 illustrates a perspective view of an alternate external embodiment of a Double Kitchen Timer. The operating principle of this configuration is the same as that of the previously described embodiment. However, the primary knob is now the upper cover member 15 of the timer. This should be knurled to provide a better grip. The secondary knob is now the middle cover member 16. Both the upper cover member 15 and the middle cover member 16 can be rotated with respect to the lower cover member 17. Both the upper and middle cover members are provided with indicia or marks 20 equally spaced around the periphery and which represent minutes of time to which the timer may be set. Numerals 19 spaced at 5 minute intervals are also provided on both cover members 15 and 16 to give meaning to the indicia. An index mark 18 is fixed on the lower cover member 17 and extends behind the middle cover member 16 (dashed lines) to surface again just below the upper cover member 15. A slight space between the upper and middle cover members accommodates the upper end of this index mark 18. The primary tab 21 is situated behind the 0 minute mark of the upper cover member and extends down to behind the upper part of the middle cover member. A secondary tab 22 is situated behind the 0 minute mark of the middle cover member 16.

When the timer is at rest, the 0 minute marks of both the upper and middle cover members are aligned with the index mark 18.

If it is desired to time a single event, the upper cover member 15 is rotated to the left with respect to the index mark 18. The primary tab 21 inside the upper cover member 15 moves against the secondary tab 22, which is inside the middle cover member 16. This causes the middle cover member 16 to turn simultaneously with the upper cover member 15. Both upper and middle cover members are thus turned until the desired time interval appears above the index marks 18. Upon release of the upper cover member 15, the common spring-wound clock mechanism causes both upper and middle cover members to return and to stop at the index mark 18 upon expiration of the desired time interval, at which time two hammer mechanisms cause two hammers to ring a common bell (similar to the initially described embodiment).

If it is to be desired to time two events, the upper cover member 15 (and simultaneously the middle cover member 16) are rotated to the left until the desired longer time interval is seen on the middle cover member 16 to be aligned with the index mark 18. Then the upper cover member 15 is rotated to the right until the desired shorter time interval is aligned with the index mark 18. Upon expiration of the desired time intervals, the respective tabs 21 and 22 are stopped at the index mark 18 and the respective hammers strike the common bell, as in the initially described embodiment.

The second embodiment has an advantage over the first embodiment in that the numerals can be made large and so can be easily seen from a distance. However, the first embodiment is likely less expensive to manufacture than the second embodiment. Therefore, the inventor states no preference of embodiments.

We claim:

1. A spring-driven timer with the capability of selection of either one or two time intervals, which consists of:

a. a case, upon which are placed numerals and indicia signifying intervals of time b. a primary and a secondary knob on a common center which are rotated in conjunction manually by means of a tab, which is part of the primary knob c. a solid shaft which extends from the primary knob to a hammer mechanism d. a hollow shaft concentric to the solid shaft which extends from the secondary knob to a second hammer mechanism e. two hammers which are cocked by their respective hammer mechanisms f. a common clock mechanism which rotates both the primary and secondary knobs g. a common bell which can be struck by either both hammers concurrently or by each hammer consecutively.

2. A spring-driven timer with the capability of selection of either one or two time intervals, which consists of:

a. upper and middle cover members each capable of independent rotation with respect to a lower cover member, and upon which are placed numerals and indicia signifying intervals of time wherein each of said members has a 0 minute mark thereon b. a primary tab at the 0 minute mark of the upper cover member and a secondary tab at the 0 minute mark of the middle cover member wherein these tabs allow the middle cover member to be rotated in conjunction with the upper cover member when the timer is initially set c. an index mark which is part of the lower cover member and which extends behind the middle cover member to the surface between the upper and middle cover members wherein said index mark provides a reference mark against which the desired time intervals can be set and (b) provides a stop for the upper and middle cover members upon expiration of the desired time interval of intervals.

d. a solid shaft which extends from the upper cover member to a hammer mechanism e. a hollow shaft concentric to the solid shaft which extends from the middle cover member to a second hammer mechanism f. two hammers which are cocked by their respective hammer mechanisms g. a common clock mechanism which rotates both the upper and middle cover members (h) a common bell which can be struck be either both hammers concurrently or by each hammer consecutively.

* * * * *